United States Patent [19]

Lyons

[11] 4,362,516

[45] Dec. 7, 1982

[54] INHIBIT LOCKS FOR MARINE ENGINE CONTROLLER

[75] Inventor: Michael D. Lyons, Lexington, Ky.

[73] Assignee: American Standard Inc., Lexington, Ky.

[21] Appl. No.: 262,563

[22] Filed: May 8, 1981

[51] Int. Cl.[3] ..... B63H 21/12

[52] U.S. Cl. ..... 440/85; 74/475; 74/878; 123/179 A; 123/198 D; 180/315; 180/333; 440/86; 440/87

[58] Field of Search ..... 440/84–87; 180/315, 333; 74/475, 878; 123/179 A, 179 F, 179 K, 198 D

[56] References Cited

U.S. PATENT DOCUMENTS

| | | | |
|---|---|---|---|
| 2,395,180 | 2/1946 | Good | 123/179 F X |
| 3,019,596 | 2/1962 | Henninger | 123/179 F |
| 4,282,769 | 8/1981 | Sandrock | 74/475 |

*Primary Examiner*—Sherman D. Basinger
*Attorney, Agent, or Firm*—R. S. Visk

[57] ABSTRACT

An inhibit lock arrangement for a marine engine controller including a valve-operating shaft axially movable by an operator's handle, when set in a "start" position, for opening a valve whereby a fluid pressure signal is transmitted to the engine to start the engine. Axial movement of the shaft may be blocked by a piston rod actuated by a cylinder when the cylinder is pressurized by a pressure signal indicating an undesirable engine operating or malfunctioning condition. A pair of pivotable latches disposed on each side of the operator's handle for retaining the handle in a neutral position until a release piston is actuated by the operator for releasing the latches and permitting the handle to be moved through a slot but not into the "start" positions until the undesirable condition has been eliminated.

3 Claims, 5 Drawing Figures

FIG. 1
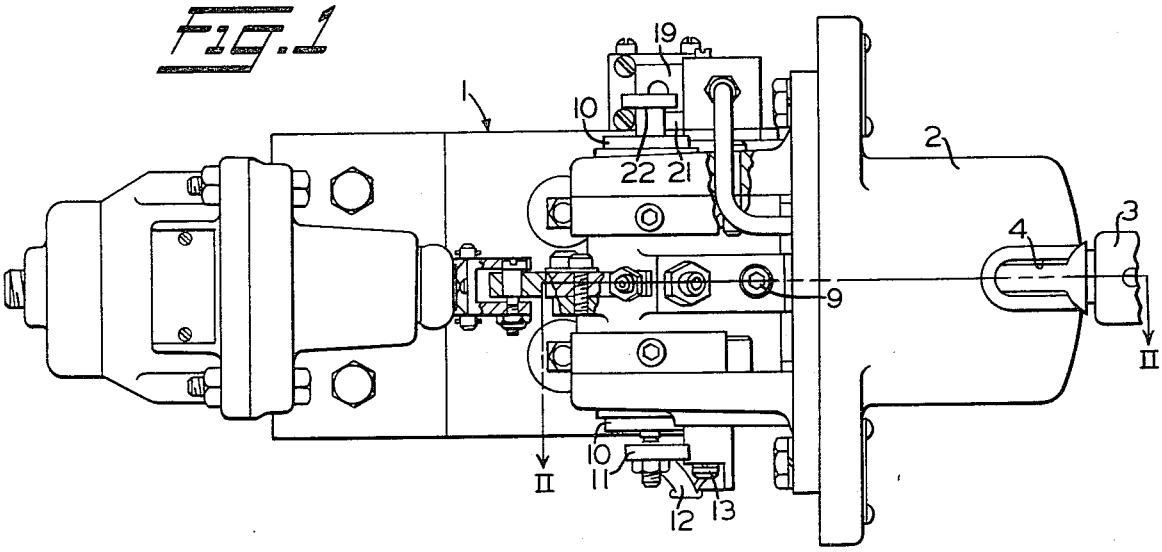
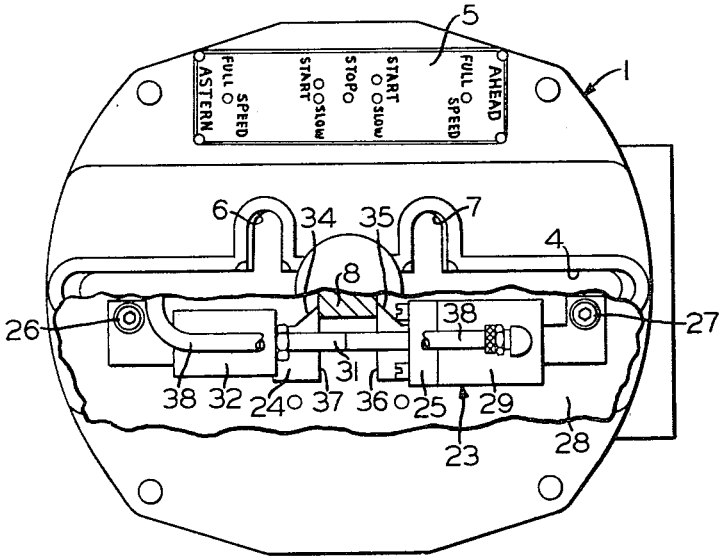
FIG. 3
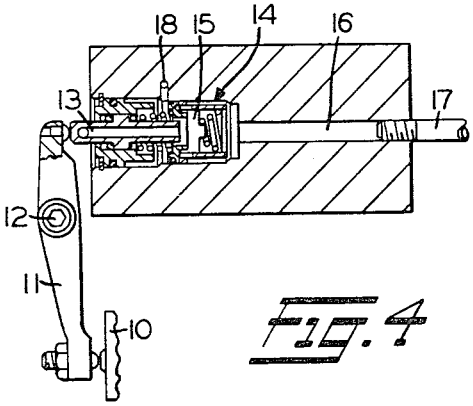
FIG. 4
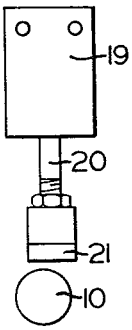
FIG. 5

3
4
2
38
29
38
23
31
32
27
30
25
34
26
35
36
37
8
24
33
IV
9
1
10

INHIBIT LOCKS FOR MARINE ENGINE CONTROLLER

BACKGROUND OF THE INVENTION

Since it is undesirable to start a direct reversing marine engine unless all operating conditions for doing so are favorable, means should be provided for automatically preventing engine start until any undesirable conditions have been corrected.

Presently known means include directional valves for intercepting pneumatic control signals, during such time that an adverse condition exists and until such time that the adverse condition is corrected. One disadvantage of this method is that the interconnection of the control signal, which is normally a pneumatic graduated signal (depending upon the degree of operation, such as speed for example, being effected), by the directional valves, is that the graduating effect of the signal has either been diminished or nullified by the time it is unblocked by the directional valve. Another disadvantage of this presently known method is that the operation of the engine controller has no apprisal that the control has been intercepted.

SUMMARY OF THE INVENTION

The object of the present invention, therefore, is to provide a marine engine controller which permits the operating handle to be moved into a neutral position from either direction, but prevents movement thereof out of said neutral position as long as an adverse condition prevails, thus positively apprising the operator of the existence of a prevailing adverse condition.

Briefly the invention resides in a marine engine controller in which a controller handle, when moved into a "start" position (either forward or reverse) normally causes axial movement of a shaft, such axial movement causing an engine-starting valve to be operated to provide a pneumatic impulse for starting the engine. In the event that an adverse condition, such as a stuck throttle, for example, exists at the time the operator attempts to start the engine, a cylinder device, including a piston rod, is automatically actuated to cause a free end of the rod to be interjected into a groove of the valve-operating shaft to prevent axial movement thereof and, therefore, operation of the engine-starting valve. A pair of mechanical latches, one on each side of the controller handle allow the handle to be moved to a neutral position (but not in a "start" position) in which position said handle is latched until released by the operator by pressurizing a latch release cylinder mechanism.

BRIEF DESCRIPTION OF THE DRAWINGS

In the drawings:

FIG. 1 is a frontal view, in outline, of a marine engine controller, shown in a position in the drawing rotated 90° clockwise relative to its normal installed position;

FIG. 3 is an end view, partly cut away, of the controller shown in FIG. 1, as viewed from the right-hand end;

FIG. 4 is a sectional view taken along line IV—IV of FIG. 2, as viewed in the direction indicated by the arrows; and FIG. 5 is a fragmentary portion of FIG. 1, as viewed from the top thereof.

DESCRIPTION AND OPERATION

Figure 2:
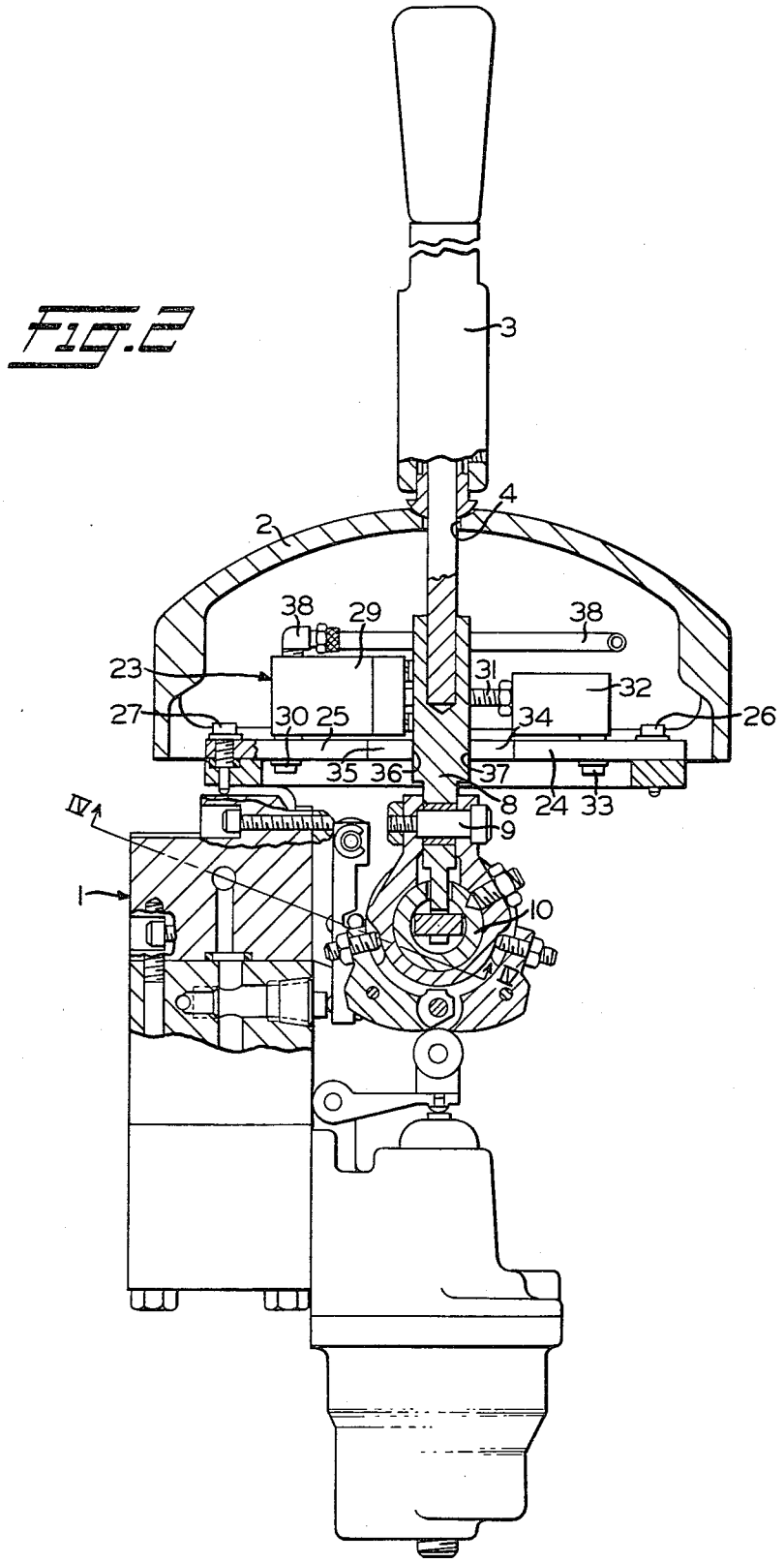
FIG. 2 is an elevational view, partly in section and partly in outline, of the controller shown in FIG. 1 taken along line II—II of FIG. 1, as viewed in the direction indicated by the arrows.

A marine engine controller 1, as shown in FIGS. 1 and 2, comprises a valve handle housing portion 2 in which a controller handle 3 is angularly displaceable in a main slot 4 so as to set the controller in one of a plurality of operating positions indicated on a plate 5 secured on said housing portion opposite the handle. In order to start the engine (not shown), handle 3 must be displaced angularly out of a neutral position, in which it is shown best in FIG. 3, in main slot 4 to a position opposite one of the "Start" positions indicated on plate 5 (see FIG. 3), then moved laterally into one of the "Start" slots 6 or 7, depending on the direction of travel desired, either ahead or astern, said slots being disposed perpendicularly to main slot 4 and off the same side thereof.

As handle 3 is moved into the selected slot 6 or 7, an inner end 8 thereof pivots about a fixed pin 9, as may be clearly seen in FIG. 2 of the drawings. Pivotal motion of portion 8 of handle 3 causes axial movement of a value shaft 10 in a left-hand direction, as viewed in FIG. 4 of the drawings (regardless of which of the "start" positions, ahead or astern, is selected). Axial movement of shaft 10, one end of which contacts an adjacent end of a pivoted valve lever 11, causes pivotal motion of said lever about a fixed pin 12, so that an operating stem 13 of a fluid pressure supply valve 14 is axially moved thereby to effect unseating of a valve element 15. When valve element 15 is unseated, fluid pressure from a passageway 16, connected to a source via a conduit 17, flows past said unseated valve element to an engine-starting device (not shown) via a port 18.

At the time engine-starting is initiated, as above described, should there exist an adverse condition indicating that the engine should not be started, a safety system (not shown) associated with the engine, produces a pressure impulse (in a manner not deemed essential to an understanding of the present invention) which causes a piston device 19 to be pressurized. A piston rod 20 is thus operated to an extended or locking position in which an end 21 thereof intercepts and engages an annular groove 22 formed on valve shaft 10. See FIGS. 1 and 5. Thus, when such a condition exists, an attempt to place handle 3 in one of the "start" positions 6 or 7 is prevented because axial or lineal movement of valve shaft 10 is inhibited by rod 20 of cylinder device 19, thereby inhibiting engine-starting until such time that the adverse condition is corrected, at which time said cylinder device is automatically depressurized to cause said rod to be retracted out of groove 22.

A handle neutral latch mechanism is designated generally by reference numeral 23 and may best be seen in the cut-away view of FIG. 3. A pair of handle latches 24 and 25 disposed respectively on opposite sides of handle portion 8, are pivotally secured by pivot pins 26 and 27 on a fixed frame 28. A spring retracted cylinder device 29 is attached to latch 25 by means of a pivot pin 30 (see FIG. 2). A piston rod 31 extending from piston 29 is provided with a block-like end 32 attached to latch member 24 by means of a pivot pin 33.

As may best be seen in FIG. 3, latch members 24 and 25 have formed thereon inclined cam surfaces 34 and 35, respectively, adapted to be engaged by handle end 8 when handle 3 is moved through main slot 4. Movement of end 8 of handle 3 on one or the other of inclined cam surfaces 34 or 35 causes the respective latch member to be rotated about its respective pivot pin. For example, if handle 3 is moved from a left-hand position, as viewed in FIG. 3, toward the neutral position, in which it is shown, end portion 8 engages inclinded surface 34 to effect rotation of latch member 24 in a clockwise direction about pin 26, as viewed in FIG. 3, to allow said handle to move through main slot 4 until it encounters a facing vertical stop surface 36 formed on latch member 25. Further movement of handle 3 toward the right is prevented temporarily. Latch member 24 is also provided with a vertical stop 37 which acts in similar fashion as surface 36 when handle 3 is moved from the opposite side. Handle 3 is thus normally retained in its neutral position until released, as will presently be explained.

Spring retracted piston 29 is normally depressurized so that latch members 24 and 25 are biased to their normal latching positions, as shown in FIG. 3 and in which portion 8 of handle 3 is retained its neutral position. To allow handle 3 to be moved out of its neutral locked position, cylinder 29 must be pressurized via a conduit 38 by valve means (not shown) controlled by the operator to cause cylinder rod 31 to be extended, whereupon latches 24 and 25 are rotated about respective pivot pins 26 and 27 in clockwise and counterclockwise directions, respectively. Rotation of latch members 24 and 25, as above described, moves surfaces 36 and 37 out of the path of travel of handle end 8, which may then be operated to any of its operating positions. When pressure is released from cylinder 29, rod 31 is retracted, so that latch members 24 and 25 resume their normal positions for blocking movement of handle 3 out of its neutral position.

Having now described the invention, what I claim as new and desire to secure by Letters Patent, is:

1. Inhibit lock means for a marine engine controller comprising:

(a) an operator's handle selectively operable in opposite directions out of a central neutral position to a plurality of control positions;

(b) a valve-operating shaft engageable by said handle;

(c) a supply valve device operably engageable by said shaft and operable by axial movement thereof, in one direction, for producing an engine-starting fluid pressure control impulse;

(d) spring biased latch means for locking said operator's handle in its said neutral position;

(e) a cylinder device operably connected to said latch means and effective, when pressurized at will by the operator, for releasing said latch means and consequently the operator's handle for operation thereof to a selected control position; and (f) a piston device operable responsively to a pressure impulse, signaling a malfunctioning condition of the engine, for causing a piston rod of the piston device to be extended and engage a groove in said shaft to prevent said axial movement thereof.

2. Inhibit lock means for a marine engine controller, as set forth in claim 1, wherein said spring biased latch means comprises a latch member pivotally secured to a frame member on opposite sides of said operator's handle relative to its neutral position, the latch members normally occupying a lock position, in which said handle is inhibited from movement out of its neutral position, and being pivotally operable by said cylinder device, when pressurized, to respective positions in which movement of the handle out of its neutral position is unobstructed by the latch members.

3. Inhibit lock means for a marine engine controller, as set forth in claim 2, wherein each of said latch members is provided with a cam surface engageable by the operator's handle, upon movement thereof toward its neutral position, and effective for causing rotation of the respective latch member thus engaged out of the path of movement of the handle to permit movement of the handle to its neutral position, each of said latch members also being provided with a stop surface engageable by the handle, upon reaching its neutral position, for preventing movement thereof beyond the neutral position until pressurization of said cylinder device.

* * * * *